United States Patent [19]

Prokop et al.

[11] Patent Number: 4,683,802

[45] Date of Patent: Aug. 4, 1987

[54] DIVIDED FLOW SELF-LEVELING SYSTEM

[75] Inventors: James A. Prokop, St. Paul; David C. Truehart, Minneapolis, both of Minn.

[73] Assignee: Lull Engineering Company, Inc., St. Paul, Minn.

[21] Appl. No.: 589,950

[22] Filed: Mar. 15, 1984 (Under 37 CFR 1.47)

[51] Int. Cl.[4] ..... F15B 11/00

[52] U.S. Cl. ..... 91/516; 91/171; 91/518; 137/118

[58] Field of Search ..... 91/516, 517, 518, 532, 91/171; 137/118

[56] References Cited

U.S. PATENT DOCUMENTS

| | | | |
|---|---|---|---|
| 2,242,002 | 5/1941 | Klein | 91/515 |
| 3,179,120 | 4/1965 | Erickson | 91/516 |
| 3,363,516 | 1/1968 | Hubbard | 91/532 |
| 3,662,548 | 5/1972 | Suzuki | 91/516 |
| 3,973,580 | 8/1976 | Ueda | 137/118 |
| 4,070,857 | 1/1978 | Wible | 91/516 |
| 4,070,858 | 1/1978 | Hand | 91/516 |
| 4,121,601 | 10/1978 | Presley | 137/118 |
| 4,285,268 | 8/1981 | Deckler | 91/518 |
| 4,408,518 | 10/1983 | Diel | 91/516 |
| 4,430,926 | 2/1984 | Wallace | 91/516 |

*Primary Examiner*—Abraham Hershkovitz

*Attorney, Agent, or Firm*—Burd, Bartz & Gutenkauf

[57] ABSTRACT

A load self-leveling system for a vehicle utilizing hydraulic cylinders to operate a telescopic lifting boom and a material handling carriage. The system includes a pair of fluid flow dividers interposed between the source of hydraulic fluid under pressure and the hydraulic cylinders operating the boom and carriage. The flow dividers are structured to direct a greater flow of hydraulic fluid to the boom cylinder and a lesser flow to the carriage cylinder, the precise numeric proportions of flow division being engineered to best suit a particular vehicle, combined with the specific componentry of that vehicle. In addition to the flow dividers, the system includes reversible flow piloted check valves, override control including override relief valves to allow independent adjustments, and matched cylinder area ratios. A compact assembly housing various of the components comprising the system is disclosed.

13 Claims, 7 Drawing Figures

DIVIDED FLOW SELF-LEVELING SYSTEM

FIELD OF THE INVENTION

BACKGROUND OF THE INVENTION

This invention is directed to a divided flow self-leveling system for vehicles utilizing hydraulic cylinders, a telescopic lifting hoist, arm or boom, and a material handling attachment or carriage. Typically, a high lift loader, exemplified by Frederick et al. U.S. Pat. No. 4,147,263, has an elongated telescopic boom pivotally secured at one end to a vehicle, and a carriage such as a fork lift pivotally secured to the opposite end of the boom. An hydraulic cylinder is used to raise and lower the boom relative to the vehicle and another hydraulic cylinder is used to tilt the carriage relative to the boom. Such vehicles are in common use for building construction and similar purposes.

Because the attitude of the carriage changes as the boom is raised or lowered on its pivot connection to the vehicle, constant adjustment of the flow of fluid to the hydraulic cylinder operating the carriage is necessary to maintain the desired level load carrying position of the carriage. Current methods for maintaining the desired relative positioning of the boom and carriage include mechanical parallelogram systems or mechanical-master/hydraulic-slave loop systems. However, use of these systems is not always possible nor practical.

The principal object of the present invention, therefore, is to provide a universally applicable system to automatically maintain any desired attitude of the material handling carriage attachment relative to the lifting or hoisting boom. In addition, an override feature is provided to allow independent adjustments.

SUMMARY OF THE INVENTION

Broadly stated, the present invention is directed to a load self-leveling system for a vehicle utilizing hydraulic cylinders to operate a telescopic lifing boom and a material handling carriage in which the system includes a pair of fluid flow dividers interposed between the source of hydraulic fluid under pressure and the hydraulic cylinders operating the boom and carriage. The flow dividers are structured to direct a greater flow of hydraulic fluid to the boom cylinder and a lesser flow to the carriage cylinder, the precise numeric proportions of flow division being engineered to best suit a particular vehicle, combined with the specific componentry of the vehicle. In addition to the flow dividers, the system includes reversible flow piloted check valves, override control including override relief valves to allow independent adjustments, and matched cylinder area ratios.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 2:
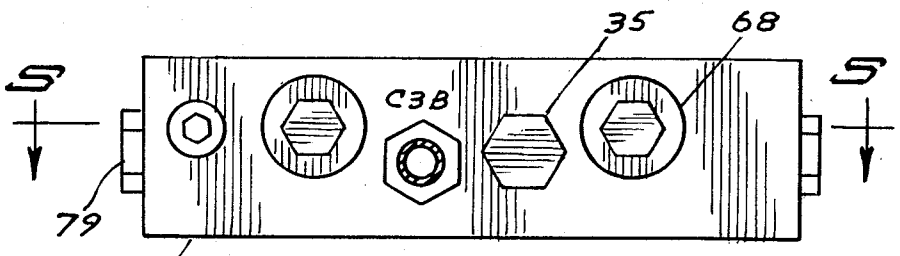
FIG. 2 is a top plan view of a compact assembly valve housing various of the components of the self-leveling system.
Figure 3:
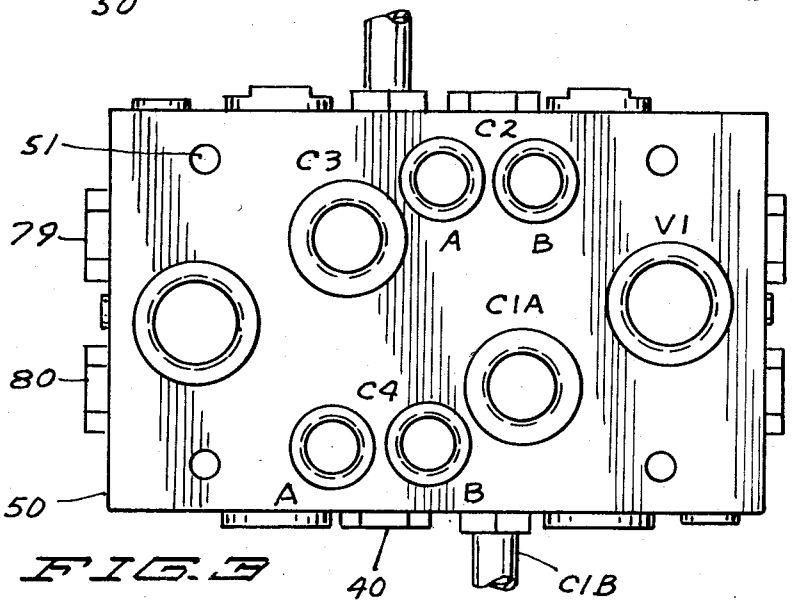
FIG. 3 is a front elevation thereof.
Figure 4:
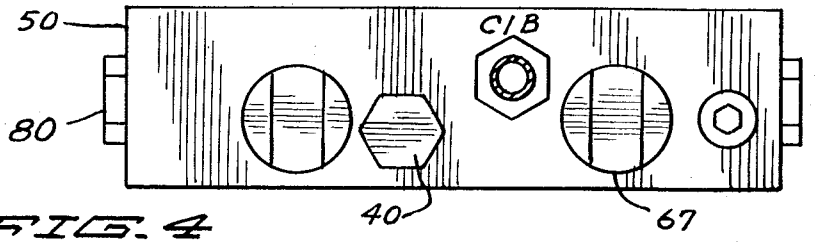
FIG. 4 is a bottom plan view thereof.
Figure 1:
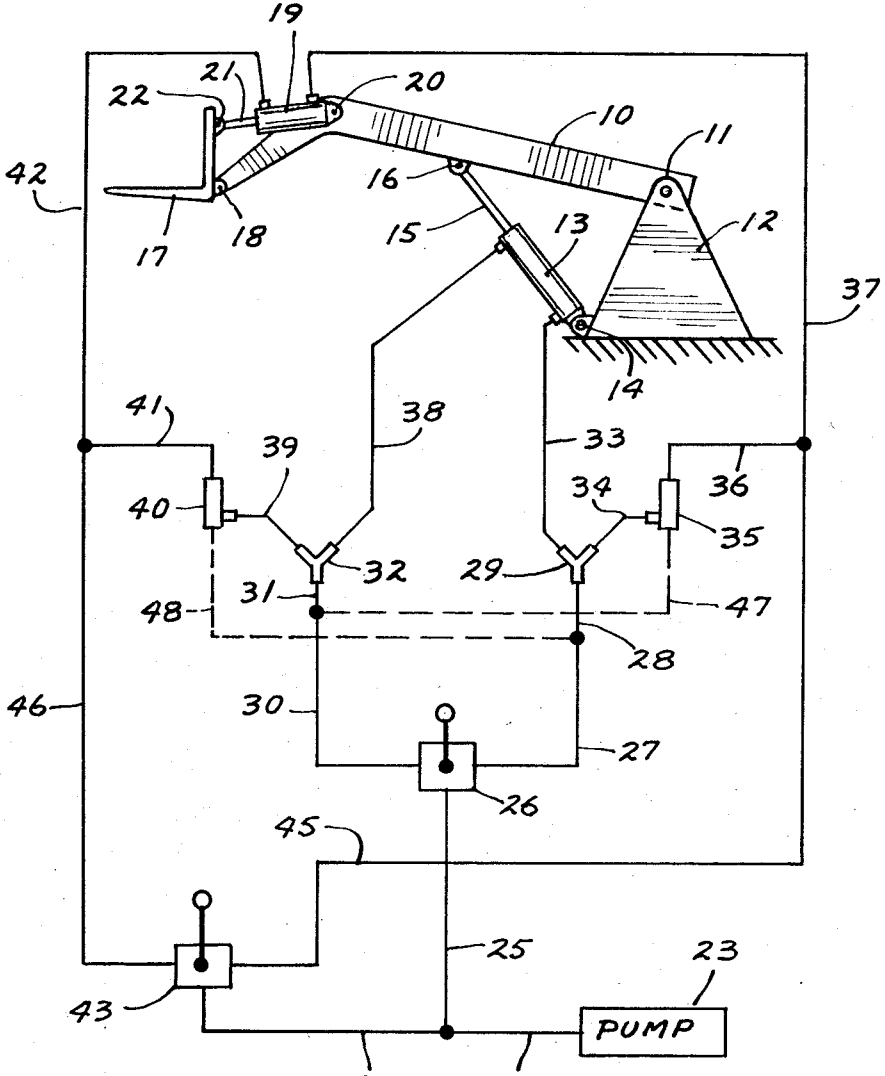
FIG. 1 is a simplified schematic representation of the self-leveling system of the present invention.

Referring now to the drawings, and particularly to FIG. 1, the self-leveling system of the present invention is shown in simplified schematic form. According to current practice, a telescopic lifting hoist or boom arm 10 is pivotally connected at 11 in a frame 12 carried by a vehicle (not shown, but which may be a vehicle such as shown in U.S. Pat. No. 4,147,263). Boom 10 is raised and lowered by means of an hydraulic cylinder 13 pivotally connected at 14 to the vehicle frame. Rod 15 of the cylinder is pivotally connected at 16 to the boom 10. A material handling carriage, here shown as a fork 17, is pivotally connected at 18 to the opposite end of boom 10. Carriage 17 is tilted about pivot 18 by means of a tilt cylinder 19 pivotally connected at 20 to boom 10. The rod 21 of cylinder 19 is pivotally connected at 22 to the carriage 17.

As is well understood, current practice is to direct hydraulic fluid to the piston ends of cylinders 13 and 19 during the boom "up" mode of operation and to the rod end during the boom "down" mode. Since the volume requirements of hydraulic fluid under pressure of the boom and carriage are reasonably proportional throughout the operating range, the object of the system of the present invention is to utilize a divided flow of oil or comparable hydraulic fluid to create a condition of self-leveling. The exactness to which such a system operates is dependent on the geometric results of incremental length changes of the operating cylinders and the accuracy obtainable from the flow dividing devices under variable pressures and rates of flow.

Although for ease of explanation the system is shown as including one boom hoist cylinder and one carriage tilt cylinder, in many or most instances a pair of hoist cylinders are used and a pair of tilt cylinders may be used.

Hydraulic fluid, such as oil, flows under pressure from a reservoir through pump 23 and through flow lines 24 and 25 to a manually operable boom hoist control valve 26 by which the mobile loader operator controls the upward and downward movement of the boom 10. From control valve 26, the oil is directed through flow lines 27 and 28 to a first flow divider 29, or through flow lines 30 and 31 to a second flow divider 32. The first flow divider 29 controls the "up" mode of operation of the boom and the second flow divider 32 controls the "down" mode. As explained in greater detail hereinafter, in the up mode the greater proportion of oil is pumped through flow line 33 to the piston side of hoist cylinder 13 to elevate boom 10. The lesser proportion of oil is pumped through flow line 34, check valve 35 and flow lines 36–37 to the piston side of the carriage tilt cylinder 19. During the down mode, the greater proportion of oil flow from the second flow divider 32 is pumped through flow line 38 to the rod side of hoist piston 13. The lesser portion of oil flow is pumped through flow line 39, check valve 40 and flow lines 41–42 to the rod side of tilt cylinder 19.

It is common practice for hydraulic cylinders to contain pilot operated safety check valves to retain fluid in the cylinders in the event of hose rupture or similar accident. As fluid is introduced to one side of the piston in a cylinder, there is a reverse flow of the fluid from the opposite side of the piston through the flow circuitry back to a reservoir. The pressure exerted by the incoming fluid must be sufficient to overcome the safety check valves to permit reverse flow.

Tilting of carriage 17 independently of up or down movement of the boom is accomplished by means of a manual tilt control valve 43. Oil from pump 23 passes through flow lines 24 and 44 to the manual control 43. To tilt carriage 17 forward, oil is pumped through flow lines 45 and 37 to the piston side of tilt cylinder 19. To tilt carriage 17 backwardly, oil is pumped through flow lines 46 and 42 to the rod side of tilt cylinder 19. Check valves 35 and 40 function whenever the carriage is being independently adjusted to prevent the inadvertent flow of oil to the boom operating cylinder through the flow dividers.

The check feature of valves 35 and 40 is removed for reverse flows during the self-leveling mode by pressure generated in the opposite incoming stream. This pressure mechanically opens the check valves 35 and 40 through a pilot control port, as explained in greater detail hereinafter. As an illustration, in the up mode, as pressure is exerted upon the piston side of the hoist and tilt cylinders, a reverse pressure is exerted by the oil being forced from the rod sides of those cylinders. The oil from the rod side of tilt cylinder 19 is permitted to flow backwardly through check valve 40 because of the greater pilot pressure on that valve due to connection to the hoist pressure line.

An override control enables the operator to change the carriage attitude at any time, even during the self-leveling mode. As seen in FIG. 1, the oil directed by the override control is brought into the system downstream of the flow dividers 29 and 32 by means of flow lines 47 and 48, respectively. Override relief valves are incorporated in the body of the override control and serve to relieve divided oil flow in the event the carriage cylinder comes to the fully extended or collapsed configuration. Otherwise the boom cylinder would stop the instant the carriage cylinder stopped.

The cylinder area ratios are intentionally matched to produce the same geometric changes in both the up and down modes. This prevents any error in flow division or compensation from accumulating on each cycle up and down.

Referring now to FIGS. 2 through 6, there is shown a compact valve assembly incorporating a single housing two flow divider valves and six check valves and associated ports, flow lines, and connections. The housing 50 is a unitary rectangular block of steel provided with a plurality of holes 51 for mounting the assembly to the vehicle.

The valve assembly includes a plurality of ports, each to be provided with a standard fitting for connection to a hose for hydraulic fluid. The ports are as follows:

V-1 for connection to the oil flow line between the manual operating control and up mode flow divider;

V-2 for connection between the manual operating control and down mode flow divider;

C-1 for connection to the oil flow line between the up mode flow divider and the piston side of the hoist cylinder. This port and those below are provided with two entries A and B for connection to parallel pairs of cylinders;

C-2 for connection to the flow line between the up mode flow divider and piston side of the carriage tilt cylinder;

C-3 for connection to the flow line between the down mode flow divider and the rod side of the hoist cylinder; and C-4 for connection to the flow line between the down mode flow divider and the rod side of the carriage tilt cylinder.

Figure 6:
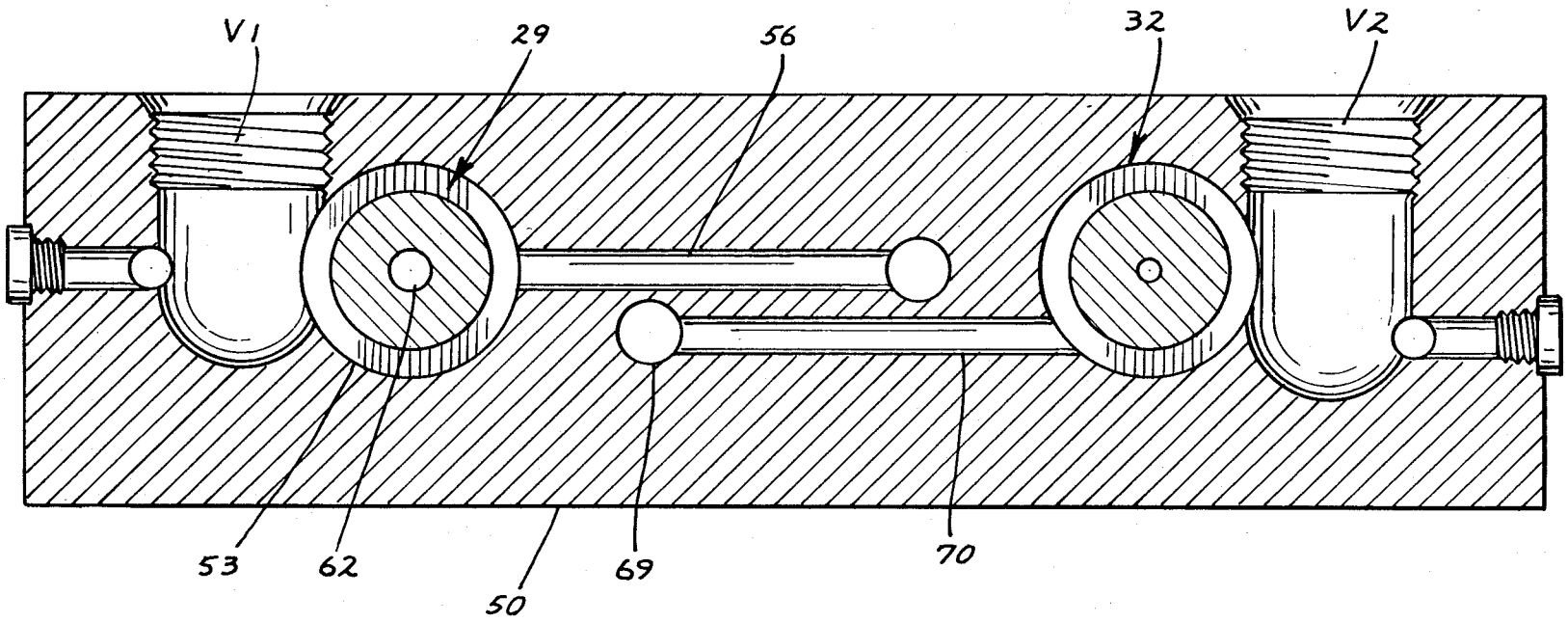
FIG. 6 is a section on the line 6—6 of FIG. 5 and in the direction of the arrows.

Flow divider 29 is in the form of a spool valve housed with a slide fit in a passage 52 extending vertically through the valve housing. (References to vertical and horizontal, upper and lower, and like expressions, pertain solely to relationships shown in the drawings. The orientation of the valve housing on the vehicle is immaterial.) Passage 52 communicates with three concentric enlarged diameter annular passages 53–55. Annular passage 53 is located approximately midway between the ends of passage 52 and communicates directly with port V-1 and a flow line passage 56 to check valve 40 (FIG. 6). Annular passage 54 communicates with ports C-1 A and B, and, through a short passage, with spring biased ball check valve 57. Annular passage 55 is connected through a short passage with check valve 35, and, through a short passage with a spring biased ball check valve 58.

Flow divider spool valve 29 has a constricted throat in its mid-section through which transverse passage 59 extends. Both opposite ends of the spool valve are open and contain flow passages 60 and 61. Passages 59 and 60 are interconnected through a relatively larger axial passage 62 and passages 59 and 61 are connected through a relatively smaller aperture 63. These apertures of varying size accomplish the desired flow dividing function. Larger aperture 62 is sized to permit the passage of about 80 to 90 per cent of the oil flow while smaller aperture 63 passes about 20 to 10 per cent of the oil flow. An 85 to 15 per cent division is typical.

Figure 5:
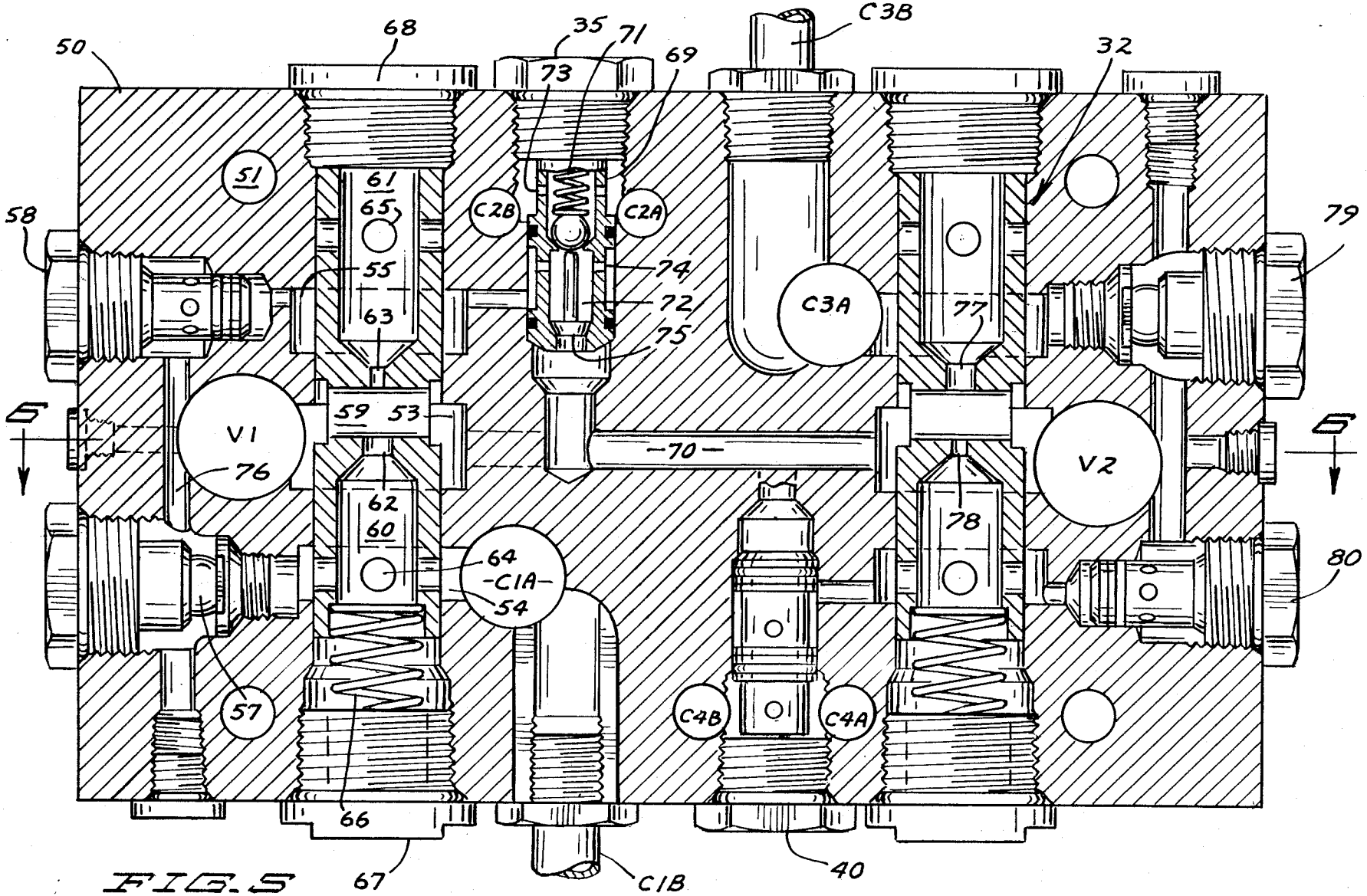
FIG. 5 is a section, on an enlarged scale, on the line 5—5 of FIG. 2 and in the direction of the arrows showing in detail the internal structure of the assembly and the components housed therein.

A plurality of flow passage holes 64 permit flow of oil between spool passage 60 and annular passage 54 and thence to hoist cylinder 13. Similarly, a plurality fo passage holes 65 permit flow of oil between spool passage 61 and annular passage 55 when the position of the spool valve is shifted, downwardly as seen in FIG. 5, to bring the passages into direct fluid communication, and thence through check valve 35 to tilt cylinder 19.

Preferably the spool valve is spring biased, as, for example, by helical spring 66 seated in an enlarged recess at the outermost end of passage 60. While not essential, the spring loading insures operation of the spool valve under low flows, as in slow operation. It insures maintenance of comparable conditions under both high and low flows.

The ends of passage 52 are closed by gasketed screw plugs 67 and 68. The spool valve may be removed, for example, by removing plug 67, as for cleaning. The enlarged spring recess prevents accidental replacement of the spool valve with the different sized apertures 62 and 63 in the wrong positions.

The reciprocation of the flow divider spool valve 29 in passage 52 permits prioritizing of oil flow. With the spool valve in the position shown, with the initial surge of pressure due to inward flow of oil through port V-1, the flow of oil is into annular passage 53, transverse passage 59, aperture 62 and passages 60, 64 and 54 to ports C-1 and flow line 33 (FIG. 1 and FIG. 7) to initiate the hoisting action prior to tilting of the carriage. As the pressure builds, the spool valve is reciprocated to bring passages 65 and 55 into communication to then permit the lesser flow of oil through aperture 63 and passages 61, 65 and 55 to check valve 35 and ports C-2 to the tilt cylinder.

Check valves 35 and 40 are identical in structure. They are standard purchased, pilot operated, spring biased ball checks, as shown particularly with respect to valve 35. Check valve cartridge 35 is housed in a passage 69 divided into three sections by means of O-ring fittings. The lowermost end of the passage 69 is connected through passage 70 to port V-2. The uppermost section is connected to ports C-2 A and B which connect to the carriage tilt cylinder. The interior of the valve is separated into two chambers 71 and 72. The upper chamber 71 communicates with passage 69 through a plurality of passage holes 73. It communicates with the lower chamber 72 through a valve seat normally closed by a spring biased ball valve element. The lower chamber 72 communicates with the middle section of passage 69 through a plurality of passage holes 74. Lower chamber 72 communicates also with passage 70 through a valve seat closed by a stemmed pilot disc valve element 75. Operation of the pilot valve 75 removes the check feature of check valve 35 for reverse flow during the self-leveling mode by virtue of pressure on the pilot valve generated by the incoming stream of oil from the opposite sides of the operating cylinders.

Once the spool valve reciprocates to its lower position, the smaller portion of the flow of oil through aperture 63 into passage 61 is directed through annular passage 55, to the middle section of passage 69 housing check valve 35, through holes 74 into chamber 72, past the ball check element and through holes 73 to the ports C-2 A and B connected to the piston side of the tilt cylinder.

Check valves 57 and 58 function to permit reverse flows from the operating cylinders to bypass the flow divider spool valve 29. Thus, when the hoist and tilt cylinders are being operated in the down mode, the reverse flow of oil from the hoist cylinder enters through ports C-1 A and B into annular passage 54 and thence, bypassing the spool valve, through check valve 57 and passage 76 to port V-1 to the oil reservoir. Similarly, oil from the piston side of the tilt cylinder enters ports C-2 A and B, past the ball check overridden by the pilot valve stem, through passages 74 to annular passage 55 and check valve 58. Thence, the oil flows through passage 76 to the port V-1.

The structure of the down mode flow divider spool valve 32 is basically the same as that of flow divider spool valve 29, already described in detail, with one important exception. The relative positions of the larger flow divider aperture 77 and smaller flow divider aperture 78 are reversed, as shown. The spring bias is on the side of the smaller aperture. Initiation of the tilt of the carriage in the down mode is prioritized over initiation of the lowering of the boom by directing the initial impulse of pressure of the incoming oil flow through port 52 out through check valve 40 to ports C-4 A and B and thence to the rod side of the tilt cylinder 19. This is followed quickly, upon reciprocation of the valve 32 by direction of the larger portion of the divided flow to ports C-3 A and B and thence to the rod side of hoist cylinder 13. Check valves 79 and 80 function in the same manner as their counterparts 57 and 58 to divert reverse flow oil from the rod sides of the hoist and tilt cylinders around the flow divider 32 during the up mode of operation and return it to the oil reservoir through port V-2.

Figure 7:
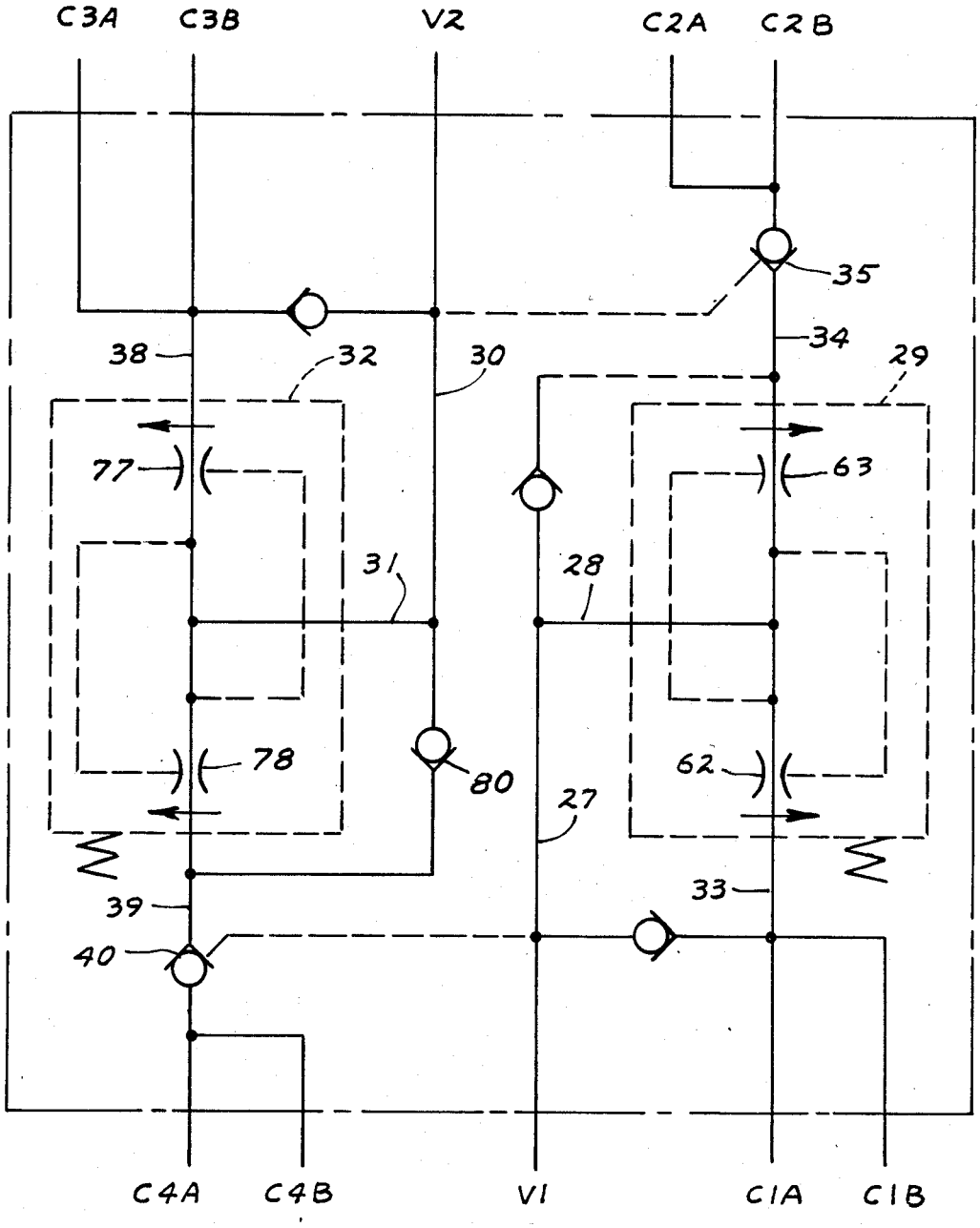
FIG. 7 is a more detailed schematic of hydraulic flow within the valve housing.

The components and flow paths of the compact valve assembly of FIGS. 2–6 are shown schematically in FIG. 7 and related to the flow lines of schematic illustration of FIG. 1. It will be understood that all fittings are made fluid-tight, as by means of O-rings or gaskets or similar sealing materials.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. In combination, a vehicle utilizing a hydraulic boom cylinder to operate a lifting boom and a hydraulic carriage cylinder to operate a material handling carriage, each of said cylinders including a piston, said pistons when moved toward their "up" sides causing the boom and carriage to move in one direction and when moved toward their "down" sides causing the boom and carriage to move in the opposite direction, and a load self-leveling system for said vehicle, said system comprising a pair of fluid flow dividers interposed in flow lines between a source of hydraulic fluid under pressure and the hydraulic cylinders operating the boom and carriage, said flow dividers being structured to direct a greater flow of hydraulic fluid to the boom cylinder and a lesser flow to the carriage cylinder, each of said flow dividers being a reciprocable spool valve in a flow passage between said source of hydraulic fluid and said cylinders, said system including:

(A) a housing for said flow divider spool valves, (B) a pair of "up" and "down" mode inlet-outlet ports in said housing for connection to said source of hydraulic fluid, and at least two pairs of "up" and "down" mode outlet-inlet ports in said housing for connection to said cylinders, (C) separate passages connecting one of said inlet-outlet ports to one of said pairs of outlet-inlet ports, and (D) said spool valves each comprising:

(1) an elongated cylindrical body having a transverse passage between the ends thereof and an axially extending passage in each end, and (2) a pair of restricted flow axial apertures between said transverse passage and said axially extending passages, one of said apertures being significantly smaller than the other.

2. The combination according to claim 1 wherein a check valve is interposed in said housing in the flow lines between each of said spool valves and ports connecting to the "up" and "down" sides of the carriage cylinder.

3. The combination according to claim 2 wherein:

(A) a separate passage bypassing said spool valve is provided between said inlet-outlet and outlet-inlet ports, and (B) a further check valve is interposed in each of said separate passages.

4. The combination according to claim 2 wherein said check valve is a pilot actuated valve including:

(A) a pair of chambers, (B) a valve seat and spring biased valve element between said chambers, (C) a further valve seat and stemmed pilot valve element closing one of said chambers, (D) a fluid flow connection between the "up" mode inlet-outlet port to said source of hydraulic fluid and the pilot valve element of the "down" mode check valve, and a further fluid flow connection between the "down" mode inlet-outlet port to said source of hydraulic fluid and the pilot valve element of the "up" mode check valve.

5. The combination according to claim 1 wherein said flow dividers direct about 80 to 90% of the total hydraulic fluid flow to the boom cylinder and about 20 to 10% of the total flow to the carriage cylinder.

6. The combination according to claim 1 wherein means are provided whereby the carriage may be tilted independently of lifting of the boom, said means including:

(A) a manually operable carriage flow control valve and a fluid flow line from the fluid source to said control valve, and (B) a pair of flow lines from the carriage control valve to the "up" and "down" sides of the piston of the carriage cylinder.

7. In combination, a vehicle utilizing hydraulic cylinders to operate a lifting boom and a material handling carriage, each of said cylinders including a piston, said pistons when moved toward their "up" sides causing the boom and carriage to move in one direction and when moved toward their "down" sides causing the boom and carriage to move in the opposite direction, and a load self-leveling system, said vehicle including:

(A) an elongated boom pivotally attached at one end to said vehicle, (B) an hydraulic lifting cylinder and piston pivotally connected between the vehicle and boom, (C) a material handling carriage pivotally attached to the opposite end of the boom, (D) an hydraulic tilting cylinder and piston pivotally connected between the boom and carriage, (E) a source of hydraulic fluid under pressure, (F) a manually operable flow control valve and a fluid flow line from the fluid source to said valve, (G) a pair of fluid flow lines from the control valve to the "up" side of the pistons of each of said cylinders, and a pair of fluid flow lines from the control valve to the "down" side of the pistons of each of said cylinders, and said load leveling system comprising:

(H) a first flow divider in the pair of flow lines between the boom control valve and the "up" side of each of said pistons, and a second flow divider in the pair of flow lines between the control valve and the "down" side of each of said pistons, said flow dividers being structured to direct a greater flow of hydraulic fluid to the boom cylinder and a lesser flow to the carriage cylinder, each of said flow dividers being a reciprocable spool valve in a flow passage between said source of hydraulic fluid and said cylinders, (I) a housing for said flow divider spool valves, (J) a pair of "up" and "down" mode inlet-outlet ports in said housing for connection to said source of hydraulic fluid, and at least two pairs of "up" and "down" mode outlet-inlet ports in said housing for connection to said cylinders, (K) separate passages connecting one of said inlet-outlet ports to one of said pairs of outlet-inlet ports, and (L) said spool valves each comprising:

(1) an elongated cylindrical body having a transverse passage between the ends thereof and an axially extending passage in each end, and (2) a pair of restricted flow axial apertures between said transverse passage and said axially extending passages, one of said apertures being significantly smaller than the other.

8. The combination according to claim 7 wherein a check valve is interposed in said housing in the flow lines between each of said spool valves and ports connecting to the "up" and "down" sides of the carriage cylinder.

9. The combination according to claim 8 wherein:

(A) a separate passage bypassing said spool valve is provided between said inlet-outlet and outlet-inlet ports, and (B) a further check valve is interposed in each of said separate passages.

10. The combination according to claim 7 wherein said check valve is a pilot actuated valve including:

(A) a pair of chambers, (B) a valve seat and spring biased valve element between said chambers, (C) a further valve seat and stemmed pilot valve element closing one of said chambers, (D) a fluid flow connection between the "up" mode inlet-outlet port to said source of hydraulic fluid and the pilot valve element of the "down" mode check valve, and a further fluid flow connection between the "down" mode inlet-outlet port to said source of hydraulic fluid and the pilot valve element of the "up" mode check valve.

11. The combination according to claim 7 wherein said flow dividers direct about 80 to 90% of the total hydraulic fluid flow to the boom cylinder and about 20 to 10% of the total flow to the carriage cylinder.

12. The combination according to claim 7 wherein a first check valve is interposed in the flow line between said first flow divider and the "up" side of the piston of the carriage cylinder and a second check valve is interposed in the flow line between said second flow divider and the "down" side of the piston of the carriage cylinder.

13. The combination according to claim 7 wherein means are provided whereby the carriage may be tilted independently of lifting of the boom, said means including:

(A) a manually operable carriage flow control valve and a fluid flow line from the fluid source to said control valve, and (B) a pair of flow lines from the carriage control valve to the "up" and "down" sides of the piston of the carriage cylinder.

* * * * *

UNITED STATES PATENT AND TRADEMARK OFFICE

CERTIFICATE OF CORRECTION

PATENT NO. : 4,683,802

DATED : August 4, 1987

INVENTOR(S) : James A. Prokop et al

It is certified that error appears in the above-identified patent and that said Letters Patent is hereby corrected as shown below:

Column 1, line 51, "the" (first occurrence), should be --that--.

Column 4, line 41, "fo" should be --of--.

Signed and Sealed this

Fifteenth Day of December, 1987

*Attest:*

DONALD J. QUIGG

*Attesting Officer*

*Commissioner of Patents and Trademarks*